US005685226A

United States Patent [19]

Fuller

[11] Patent Number: 5,685,226

[45] Date of Patent: Nov. 11, 1997

[54] ADAPTIVE CLAMPING MECHANISM FOR PRINTING PLATES

[75] Inventor: Douglas D. Fuller, Contoocook, N.H.

[73] Assignee: Presstek, Inc., Hudson, N.H.

[21] Appl. No.: 607,150

[22] Filed: Feb. 26, 1996

[51] Int. Cl.[6] ..... B41F 27/12

[52] U.S. Cl. ..... 101/415.1; 101/216; 101/DIG. 36

[58] Field of Search ..... 101/415.1, 409, 101/410, 216, DIG. 36

[56] References Cited

U.S. PATENT DOCUMENTS

| | | | |
|---|---|---|---|
| 3,154,012 | 10/1964 | Fischer | 101/415.1 |
| 4,018,158 | 4/1977 | Borneman | 101/415.1 |
| 4,202,268 | 5/1980 | Becker | 101/409 |
| 4,204,471 | 5/1980 | Becker | 101/410 |
| 4,250,810 | 2/1981 | Fowler et al. | 101/415.1 |
| 4,332,197 | 6/1982 | Dulin | 101/415.1 |
| 4,489,653 | 12/1984 | Cappel et al. | 101/415.1 |
| 4,938,135 | 7/1990 | Wieland | 101/415.1 |
| 5,052,299 | 10/1991 | Kojima | 101/415.1 |

FOREIGN PATENT DOCUMENTS

| | | | |
|---|---|---|---|
| 609099 | 1/1935 | Germany | 101/415.1 |

*Primary Examiner*—John S. Hilten
*Assistant Examiner*—Daniel J. Colilla
*Attorney, Agent, or Firm*—Cesari and McKenna, LLP

[57] ABSTRACT

An adaptive clamping assembly especially suitable for use in clamping a lithographic plate material around a cylinder. A lead clamp for receiving the leading edge of the plate is fixed along the outer surface of the cylinder parallel to the cylinder's longitudinal axis of rotation. A tail clamp for receiving the trailing edge of the plate is disposed along the outer surface of the cylinder parallel to the lead clamp. The tail clamp is mounted to a take-up assembly that is rotatably mounted within the cylinder bore so that the tail clamp can be selectively positioned along the outer surface of the cylinder relative to the lead clamp. Further rotation of the take-up assembly through rotation of the cylinder tensions the plate around the cylinder for proper imaging or printing.

20 Claims, 4 Drawing Sheets

ADAPTIVE CLAMPING MECHANISM FOR PRINTING PLATES

FIELD OF THE INVENTION

The present invention relates generally to clamping devices for securing a printing plate to a plate cylinder. More specifically, the present invention relates to an adaptive clamping mechanism which allows the plate cylinder to accommodate printing plates of various lengths.

BACKGROUND OF THE INVENTION

In offset lithography, an image is present on a printing plate as a pattern or "image" of ink-accepting (oleophilic) and ink-repellent (oleophobic) surface areas. In a typical sheet-fed offset press system, the imaged plate is mounted to a plate cylinder, where it is inked. The plate is then brought into contact with the compliant surface of a blanket cylinder. The blanket cylinder, in turn, applies the image to paper sheets which are brought into contact with the blanket cylinder by an impression cylinder.

Although the plates for an offset press were traditionally imaged photographically, more recently, a number of electronic alternatives have been developed for placing the image onto the plate. These digitally controlled imaging devices include lasers that chemically alter or destroy one or more plate layers, ink jets that directly deposit ink-repellent or ink-accepting spots on a plate blank and spark or ion discharge devices which physically alter the topology of the plate blank. These various methods of imaging lithographic plates are described in detail in U.S. Pat. Nos. 3,506,779; 4,054,094; 4,347,785; 4,911,075 and 5,385,092, among others.

Plates can be imaged on-press or, more traditionally, on an off-press platesetter. A digitally operated platesetter includes an imaging cylinder to which the plate is initially mounted, and which carries the plate past the head of the imaging device. That device transfers the image to the plate. The imaged plate is then removed from the platesetter and transferred to the plate cylinder of the printing press. When mounting an imaged plate to a plate cylinder for a press run or when mounting a plate blank to an imaging cylinder for imaging, it is essential that the leading and trailing edges of the plate be secured firmly to the cylinder and that the plate be wrapped tightly around the cylinder. This ensures that there will be no relative movement between the plate and the cylinder when the cylinder is rotated.

Various devices, including vacuum clamps and mechanical and electromechanical clamps, have been developed over the years for holding a lithographic plate to a plate cylinder. For the most part, theses devices have all tended to be relatively complex and costly. Also, in most cases, the clamping mechanisms are fixed to the cylinders such that the mechanisms can only secure a printing plate having a specific length. Since the plate blanks are often pre-cut to fit the specific plate cylinder of the printing press, a separate imaging cylinder, having the same dimensions as the printing cylinder, is generally required to image the plates associated with each printing press. The inability of platesetter and printing cylinders to accommodate differently sized plates substantially increases the cost of operating and running the printing press.

SUMMARY OF THE INVENTION

It is an object of the present invention to provide an imaging or plate cylinder that can accept printing plates of various lengths.

It is a further object of the present invention to provide a plate clamping mechanism that uses the rotation of the cylinder to tighten or loosen the printing plate wrapped around the cylinder.

Briefly, the invention comprises an imaging or plate cylinder having an outer surface, a longitudinal axis of rotation and a hollow bore. A lead clamp, for securing the leading edge of the printing plate to the cylinder, is mounted directly along the outer surface of the cylinder parallel to the cylinder axis. A tail clamp, which is also positioned along the outer surface of the cylinder parallel to the lead clamp, receives the trailing edge of the printing plate. Instead of being fixed directly to the cylinder, however, the tail clamp is mounted to a take-up assembly that is rotatably mounted within the cylinder bore. By rotating the take-up assembly relative to the cylinder, the tail damp can be selectively positioned along the outer surface of the cylinder relative to the lead clamp, thereby accommodating the particular length of the selected printing plate. Further rotation of the take-up assembly, after the printing plate has been secured to both clamps, tensions the printing plate around the cylinder for proper imaging or printing.

The primary components of the take-up assembly preferably include a support beam, two pivot plates and a subassembly (comprising a pair of cooperating gears, an actuator shaft and a cam and cam follower arrangement associated with each pivot plate). The support beam, which may be rectangular in shape, is rotatably mounted about the cylinder axis within the bore of the cylinder. Mounted along one edge of the support beam through a series of slots in the cylinder surface is the tail clamp.

The pivot plates are also disposed within the cylinder bore and are each releasably attached to a corresponding end wall of the cylinder so that each pivot plate is adjacent to a corresponding end of the support beam. The pivot plates, when released from the end walls of the cylinder, are used to make large-scale adjustments to the position of the tail clamp by rotating the support beam about the cylinder axis. The pivot plates are also used to impart the rotating motion of the cylinder to the tail clamp so that the tail clamp rotates in synchronism with the cylinder, once the tail clamp has been properly positioned to receive the trailing edge of the printing plate. The subassembly through rotation of the cylinder in a reverse direction tightens the printing plate wrapped around the cylinder. Following the imaging or printing cycle, rotation of the cylinder is again used in cooperation with the subassembly, although this time in a forward direction, to loosen the printing plate to assist in its removal from the cylinder by the press operator.

BRIEF DESCRIPTION OF THE DRAWINGS

The above and further advantages of the invention may be better understood by referring to the following description in conjunction with the accompanying drawings, in which.

DESCRIPTION OF THE PREFERRED EMBODIMENT

Figure 1:
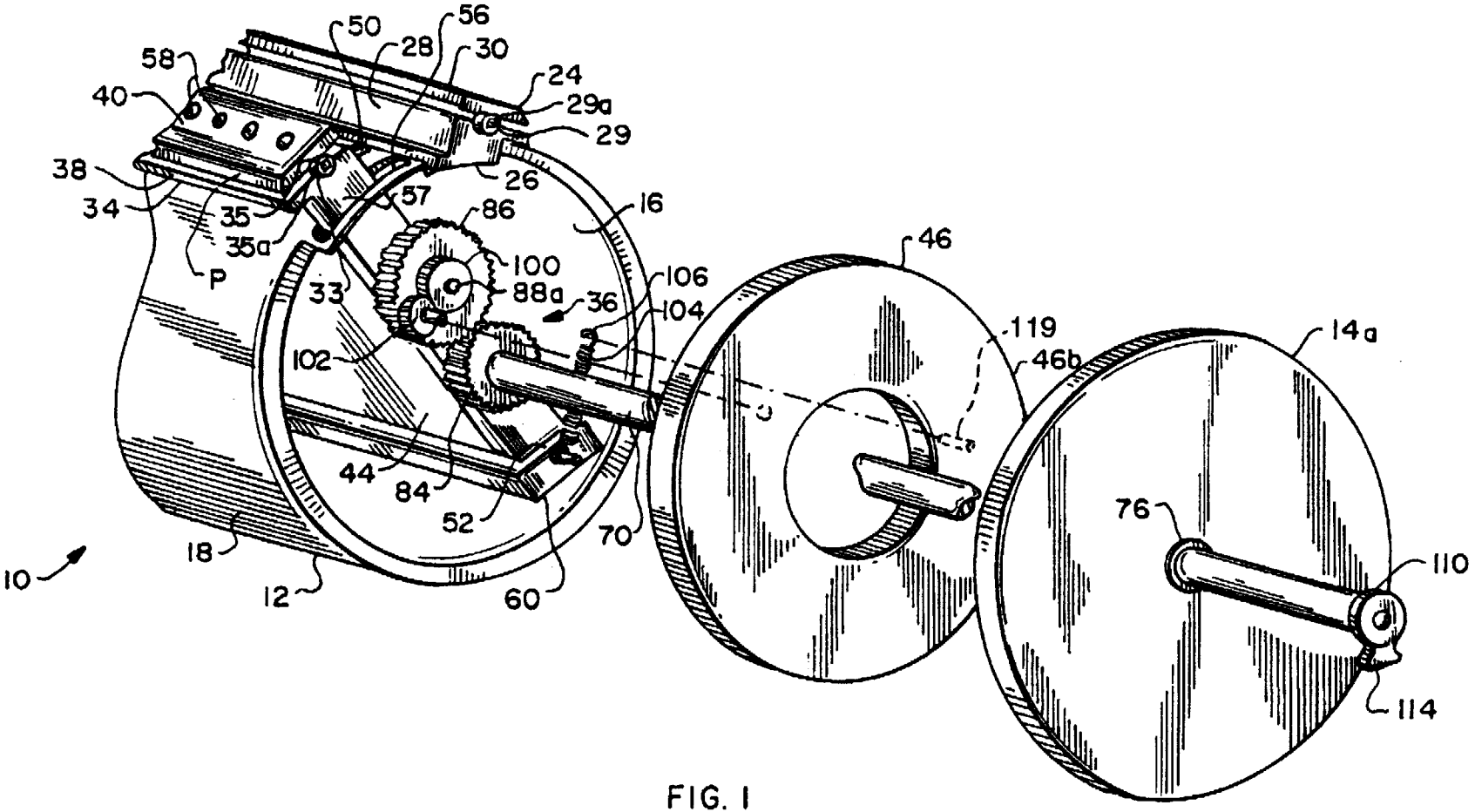
FIG. 1 is a partially exploded isometric view of the cylinder containing the components of the present invention.
Figure 2:
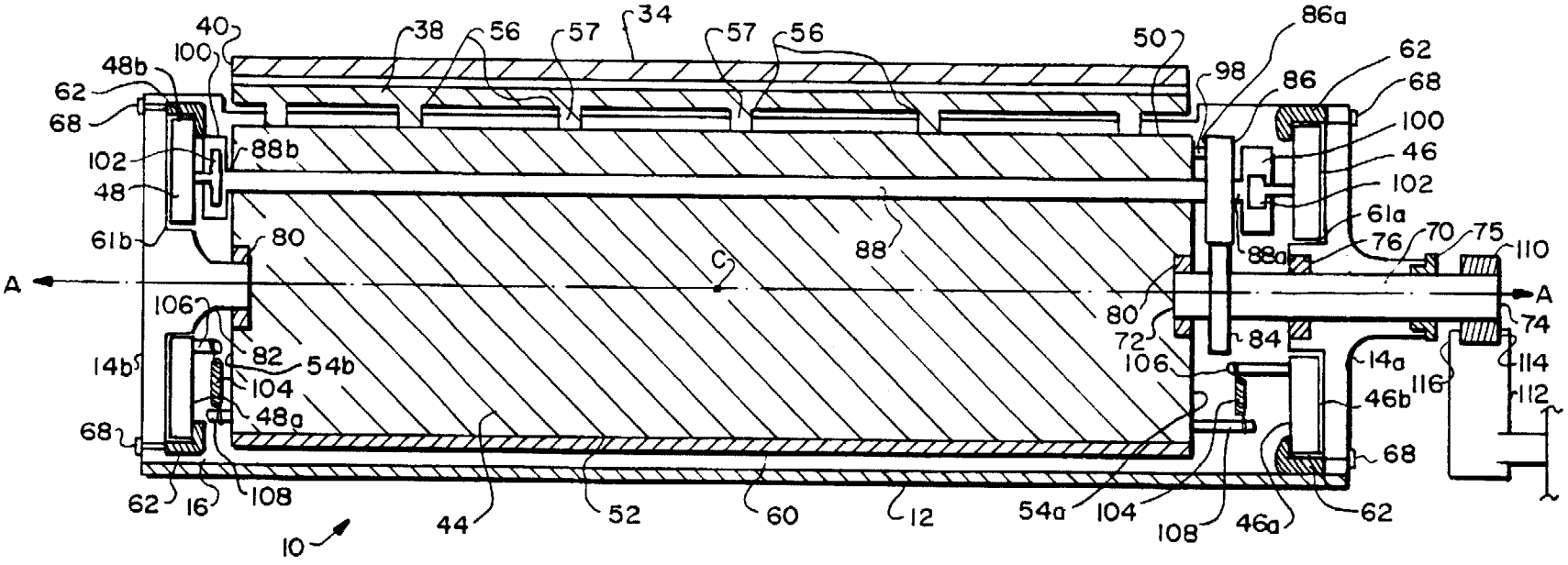
FIG. 2 is a plan view of the cylinder containing the components of the present invention.
Figure 3:
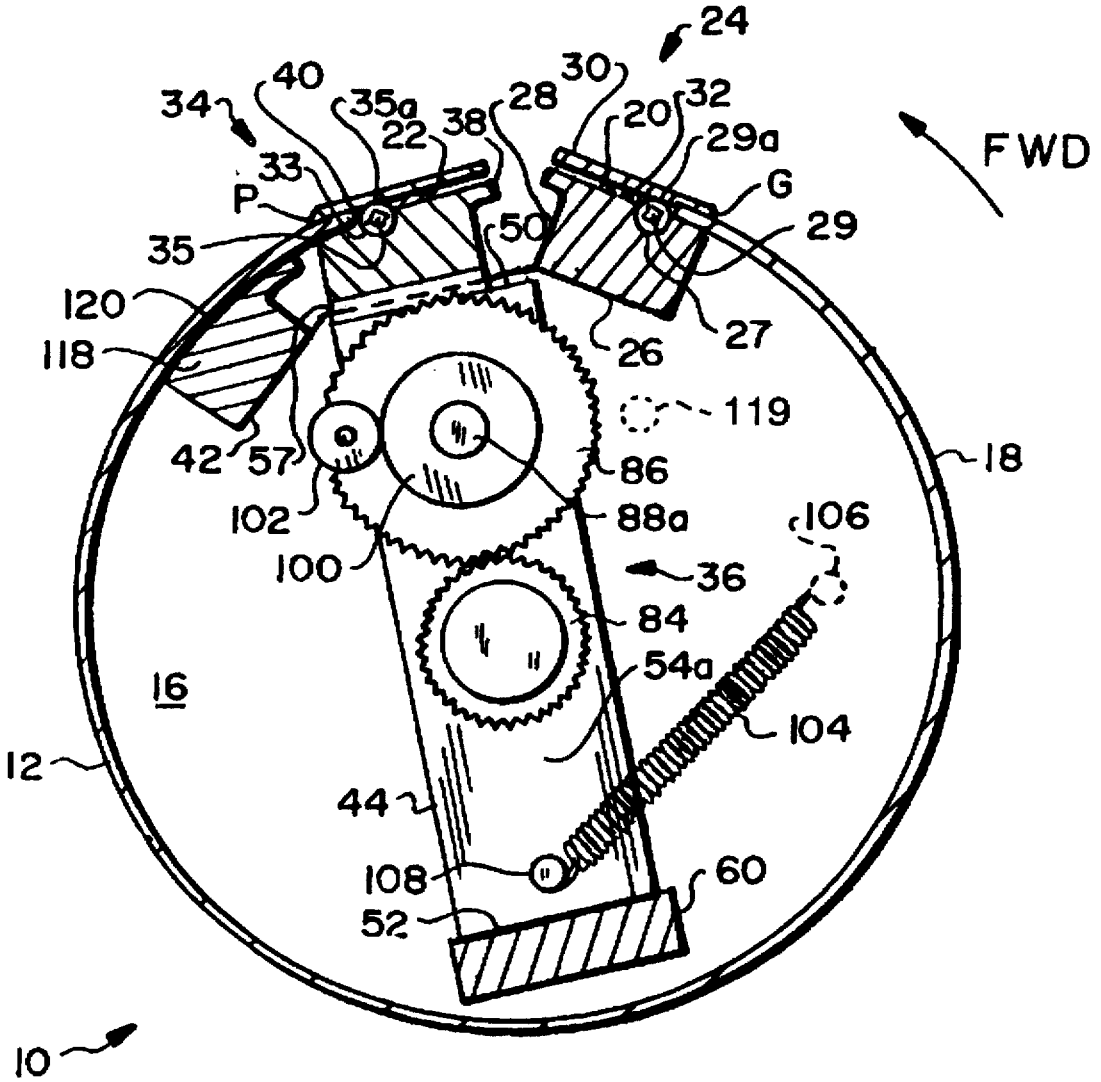
FIG. 3 is an end view of the cylinder of FIG. 2 with several components removed to show more clearly the major components of the present invention.

FIGS. 1, 2 and 3 illustrate a rotary cylinder or drum 10, which may be the plate cylinder of a lithographic press or an imaging cylinder used to prepare printing plates. The cylinder 10 has an outer cylindrical surface 12, two end walls 14*a*, 14*b* and a hollow bore 16. The cylinder 10 also has a longitudinal axis of rotation A—A and a center point C lying on the axis A—A. Wrapped around the outer surface 12 of the cylinder 10 is a printing plate 18, having a leading edge 20 and a trailing edge 22 (see FIG. 3). The printing plate 18 may be any type of recording medium, such as the digitally imaged printing plates described above or a traditional photoexposure plate.

A lead clamp 24 is mounted directly to the outer surface 12 of the cylinder 10 parallel to the cylinder axis A—A. Preferably, the lead clamp 24, which extends substantially the entire length of the cylinder 10, is mounted within a notch 26 formed in the cylinder surface 12. The lead clamp 24 may include an elongated block 28 having an axially extending groove 27 formed therein and a top plate 30 that is co-extensive with and spaced above the groove 27.

Rotatably mounted within the groove is an elongated cam 29 having a cam surface 29*a* spaced from the top plate 30 to define a gap G for receiving the leading edge 20 of the plate 18. The cam 29 is moveable from a closed or clamping position in which the cam surface 29*a* is spaced relatively close to or interfering with the top plate 30 and an open or unclamping position in which the cam surface 29*a* is spaced further away from the top plate 30. An interposing sheet (not shown), which is basically a thin, flat plate, may be disposed between the cam surface 29*a* and the top plate 30 so that the cam surface 29*a* does not directly contact the plate 18.

The leading edge 20 of the plate 18 may be secured to the lead clamp 24 between the block 28 and the top plate 30 by inserting the leading edge 20 into the gap G and rotating the cam 29 from the open to the closed position. The lead clamp 24 may also include a series of alignment pins 32 extending between the block 28 and the top plate 30 preferably just behind the elongated cam 29. By matching the alignment pins 32 with corresponding notches (not shown) in the leading edge 20 of the plate 18, proper registration of the plate 18 relative to the lead clamp 24 is ensured. Use of the interposing sheet prevents the cam 29, when being moved from the open to the closed position, from exerting any pulling force or drag on the plate 18 that might otherwise upset the registration of the leading edge 20.

The cylinder 10 further includes a tail clamp 34 extending along the cylinder surface 12 parallel to and selectively spaced from the lead clamp 24. The tail clamp 34 is mounted to a take-up assembly, designated generally 36, that is rotatably mounted within the cylinder bore 16. The tail clamp 34, which may be substantially similar to the lead clamp 24, includes an elongated block 38 having a groove 33 formed therein, a cam 35 having a cam surface 35*a* rotatably mounted in the groove 33 and a top plate 40. The trailing edge 22 of the plate 18 may be secured to the tail clamp 34 between the block 38 and the top plate 40, thereby defining a plate side P of the tail clamp 34. The tail clamp 34 is preferably disposed within a groove 42 formed in the surface 12 of the cylinder 10. As described in detail below, the tail clamp 34 can be selectively positioned circumferentially relative to the lead clamp 24 at any point within the groove 42 so that the tail clamp 34 may receive the trailing edge of printing plates having different lengths. The tail clamp 34 can also be further adjusted within the groove 42 to tighten the plate 18 about the cylinder 10. Following the imaging or printing cycle, the tail clamp 34 can be similarly adjusted in an opposite direction to loosen the plate 18.

The take-up assembly 36 includes a support beam 44, for supporting the tail clamp 34, and two pivot plates 46, 48, for selectively positioning the tail clamp 34 by rotating the support beam 44 relative to the cylinder 10. The support beam 44 is disposed within the cylinder bore 16 and preferably extends along the entire length of the cylinder 10. The support beam 44, which may be rectangular-shaped, has a first edge 50, a second edge 52 and two end faces 54*a*, 54*b* that are each proximate to a corresponding cylinder end wall 14*a*, 14*b*. The support beam 44, moreover, is supported at each end face 54*a*, 54*b*, as described below, such that the support beam 44 may rotate about axis A—A relative to the cylinder 10.

A series of parallel, circumferentially extending slots 56 are formed in the groove 42 of the cylinder 10 for attaching the tail clamp 34 to the support beam 44. The slob 56 communicate between the groove 42 and the cylinder bore 16, permitting a corresponding series of projections 57 that extend radially outward from the first edge 50 of the support beam 44 to protrude up through the slots 56 and into the groove 42. The tail clamp 34 is mounted to these projections 57 by a series of fasteners 58 (see FIG. 1). The tail clamp 34 is thus rigidly mounted to the support beam 44 without compromising the structural integrity of the cylinder 10. If necessary, a counterweight 60 may be mounted along the second edge 52 of the support beam 44 opposite the tail clamp 34 in order to balance the support beam 44 about axis A—A.

Each pivot plate 46, 48 is disposed within the cylinder bore 16 and is supported by and releasably attached to a corresponding end wall 14*a*, 14*b* of the cylinder 10. In particular, each end wall 14*a*, 14*b* preferably includes an inwardly extending support hub 61*a*, 61*b* along the cylinder axis A—A. Each pivot plate 46, 48 is rotatably supported on the corresponding hub 61*a*, 61*b* such that an inner face 46*a*, 48*a* of each pivot plate 46, 48, relative to the center point C of the cylinder 10, faces the corresponding end face 54*a*, 54*b* of the support beam 44. When released from the corresponding end wall 14*a*, 14*b*, as described below, each pivot plate 46, 48 is free to rotate about the corresponding support hub 61*a*, 61*b* relative to the cylinder 10. Rotation of the pivot plates 46, 48, which are in contact with the support beam 44, as described below, causes the support beam 44 to rotate relative to the cylinder 10 thereby selectively positioning the tail clamp 34 within the groove 42.

Each pivot plate 46, 48 is preferably attached to the corresponding end wall 14*a*, 14*b* by a series of L-shaped clamps 62 (see FIG. 2). The L-shaped clamps 62 are spaced around an outer perimeter 46*b*, 48*b* of each pivot plate 46, 48 and secured to the corresponding end wall 14*a*, 14*b* by fasteners 68. By loosening the fasteners 68 associated with a pivot plate 46, 48, the L-shaped clamps 64 release the associated pivot plate 46, 48 from the corresponding end wall 14*a*, 14*b*, thereby permitting the pivot plates 46, 48 to rotate about the corresponding support hubs 61*a*, 61*b*. When secured to the corresponding end walls 14*a*, 14*b*, the pivot plates 46, 48 transmit the rotative motion of the cylinder 10 to the tail clamp 34, since each pivot plate 46, 48 remains in contact with the support beam 44. Consequently, with the pivot plates 46, 48 secured to the corresponding end walls 14*a*, 14*b*, the tail clamp 34 is driven in synchronism with the rotating cylinder 10.

An actuator shaft 70, which is used to further position the tail clamp 34 within the groove 42, thereby tightening or loosening the printing plate 18 around the cylinder 10 extends along the cylinder axis A—A through one end wall 14*a* of the cylinder 10. A first end 72 of the actuator shaft 70 is disposed within the cylinder bore 16 and a second end 74 is disposed outside of the cylinder 10. An outer bearing 75 and an inner bearing 76 are preferably located between the actuator shaft 70 and the corresponding end wall 14*a* so that the actuator shaft 70 may rotate independently of the cylinder 10.

With particular reference to FIG. 2, each end face 54*a*, 54*b* of the support beam 44 also includes a bearing 80 that is aligned with the cylinder axis A—A. The first end 72 of the actuator shaft 70 is received within the bearing 80 disposed within the corresponding end face 54*a* of the support beam 44 and thus rotatably supports that end of the support beam 44 within the cylinder bore 16. The opposite end face 54*b* of the support beam 44 is supported by an inwardly extending boss 82, formed on the hub 61*b* of the corresponding end wall 14*b*. In particular, the boss 82, which extends along axis A—A, is received within the bearing 80 associated with the corresponding end face 54*b* of the support beam 44 so that the boss 82 rotatably supports that end of the support beam 44.

Mounted to the actuator shaft 70 adjacent to the corresponding end face 54*a* of the support beam 44 is a drive gear 84. The drive gear 84 engages a take-up assembly gear 86 rotatably mounted to the end face 54*a* of the support beam 44. More specifically, the take-up assembly gear 86 is mounted on a red 88, which extends lengthwise through the support beam 44 parallel to but offset from the cylinder axis A—A. The rod 88 has two ends 88*a*, 88*b* which protrude from the corresponding end faces 54*a*, 54*b* of the support beam 44. The rod 88 is thus free to rotate within the support beam 44. However, by applying a transverse force to the rod 88, the support beam 44 can be rotated about the cylinder axis A—A.

Figure 4B:
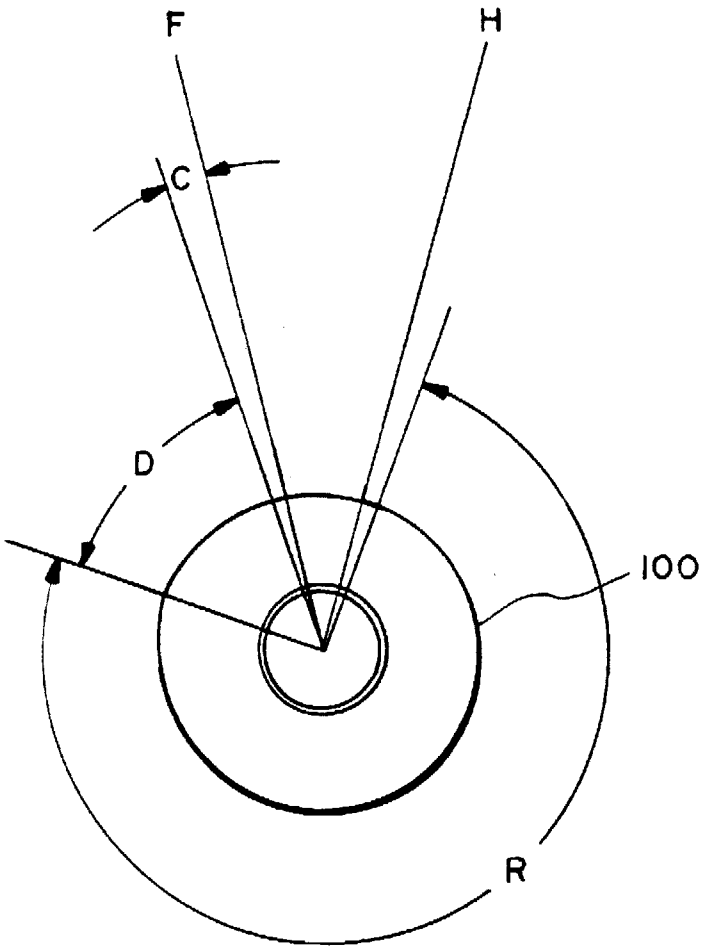
FIG. 4B is a detailed view of a preferred embodiment of the cam of the present invention.
Figure 4A:
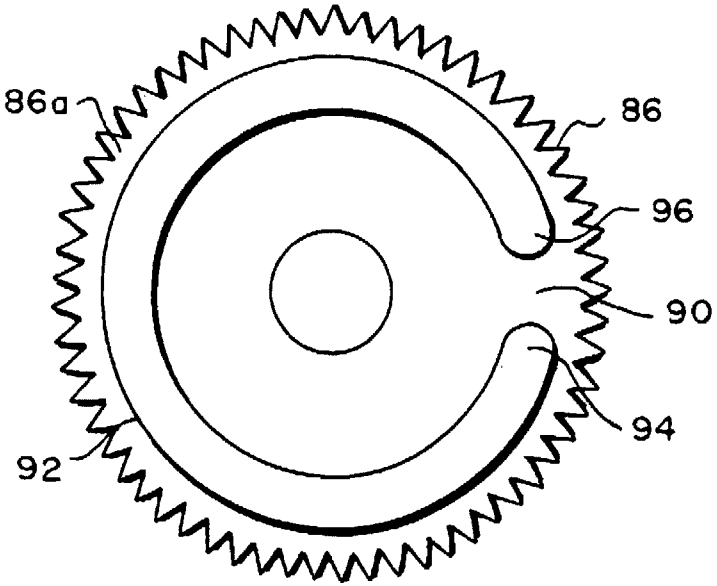
FIG. 4A is a detailed view of a preferred embodiment of the take-up assembly gear of the present invention.

As shown in FIG. 4A, the take-up assembly gear 86 includes at least one hard stop 90 to prevent the take-up assembly gear 86 from rotating more than one complete revolution in either direction. Preferably, an annular groove 92 is formed on an inside face 86*a* of the take-up assembly gear 86 relative to the center point C of the cylinder. Instead of forming a complete circle, the annular groove has two ends 94, 96, preferably spaced close together to form two hard stops 90. A stop pin 98 extends outwardly from the corresponding end face 54*b* of the support beam 44 parallel to the axis A—A and adjacent to the inside face 86*a* of the take-up assembly gear 86. A portion of the stop pin 98 protrudes into the annular groove 92 so that, as the take-up assembly gear 86 rotates relative to the support beam 44, the pin 98 rides inside the annular groove 92. When the pin 98 contacts either end of the groove 94, 96, the pin 98 prevents further rotation of the take-up assembly gear 86 in that direction.

As shown in FIGS. 1–3, mounted to the rod 88 are a pair of cams 100, each having the same ramp or surface shape. Each cam 100 is mounted on an opposite end 88*a*, 88*b* of the rod 88 so that each cam 100 is adjacent to a corresponding pivot plate 46, 48. The cams 100 are operated by rotation of the drive gear 84 which rotates the take-up assembly gear 86 thereby turning the red 88 and the cams 100. Ordinarily, the actuator shaft 70 rotates with the cylinder 10 and the drive gear 84 remains stationary with respect to the take-up assembly gear 86. Thus, there is ordinarily no rotation of the cams 100 relative to the cylinder 10.

As shown in FIG. 4B, each cam has a home position H, which corresponds to the initial placement of the trailing edge 22 of the plate 18 within the tail clamp 34. Following the home position H in a clockwise direction is an increasing ramp or rise R. The rise R covers approximately 270 degrees of the cam surface. Following the rise R is a decreasing ramp or descent D which covers approximately 45 degrees. The descent D is followed by a dwell or constant diameter section C, which corresponds to the final position F of the cam 100.

Referring again to FIGS. 1–3, a cam follower 102 associated with each cam 100 is rotatably mounted to the inner face 46*a*, 48*a* of each pivot plate 46, 48 such that each cam follower 102 is in contact with the corresponding cam 100. In particular, each cam follower 102 lies within the same plane as the corresponding cam 100 and contacts the cam 100 on the side corresponding to the plate side P of the tail clamp 34. Although free to rotate relative to the corresponding pivot plate 46, 48, each cam follower 102 is fixed in position on the corresponding pivot plate 46, 48 off-set from the cylinder axis A—A. Accordingly, rotation of the cams 100, with the cam followers 102 fixed, exerts a transverse force on the rod 88 and rotates the support beam 44.

Each cam follower 102 is held in contact with the corresponding cam 100 by a return spring 104 associated with each pivot plate 46, 48 and disposed within the cylinder bore 16. Each return spring 104 has two ends 106, 108 and is mounted between the associated pivot plate 46, 48 and the adjacent end face 54*a*, 54*b* of the support beam 44 such that each spring 104 lies within a plane perpendicular to the cylinder axis A—A. Preferably, one end 106 of each return spring 104 is mounted to the corresponding pivot plate 46, 48, proximate to the outer perimeter 46*b*, 48*b* of the pivot plate 46, 48. The other end 108 of the return spring 104 is mounted to the adjacent end face 54*a*, 54*b* of the support beam 44 in proximity to the second edge 52 of the support beam 44 which carries the counterweight 60. Each return spring 104, moreover, is biased such that the spring 104 urges the cam 100 against the corresponding cam follower 102.

Mounted to the second end 74 of the actuator shaft 70 outside of the cylinder 10 is a slip clutch 110 for engagement with a matching pawl 112. The slip clutch 110 includes a receiving knob 114 that extends radially outward from the slip clutch 110. The pawl 112, which is also located outside of the cylinder 10, is preferably positioned such that rotation of the pawl 112 causes a pawl tooth 116 to engage the knob 114 of the slip clutch 110, thereby arresting any rotation of the actuator shaft 70. The pawl tooth 116 and the knob 114 are shaped so that the pawl tooth 116 will arrest the rotation of the actuator shaft 70 in either direction.

The slip clutch 110 is preferably keyed onto the second end 74 of the actuator shaft 70 and ordinarily rotates in synchronism with the actuator shaft 70. The slip clutch 110, however, is designed to slip relative to the actuator shaft 70 when the torque on the shaft 70 reaches a pre-selected limit. Thus, at torques above the pre-selected limit, the slip clutch 110 allows the actuator shaft 70 to rotate despite engagement of the slip clutch 110 by the pawl 112.

Operation of the adaptive clamping mechanism of the present invention may be understood with continued reference to FIGS. 1–3. To prepare the cylinder 10 for imaging or printing, the leading edge 20 of the selected plate 18 is first attached to the lead clamp 24, by inserting the leading edge 20 of the plate 18 into the gap G in the lead clamp 24 and turning the cam 29 from the open to the closed or clamping position. The plate 18 is then wrapped around the cylinder surface 12 by the press operator until the trailing edge 22 is brought into proximity with the tail clamp 34. In order to adjust the position of the tail clamp 34 to receive the trailing edge 22 of the plate 18, the pivot plates 46, 48 must be released from the corresponding end walls 14*a*, 14*b*. To release the pivot plates 46, 48, the press operator loosens the fasteners 68 associated with the L-SHAPED clamps 62. The pivot plates 46, 48 are now free to rotate relative to the cylinder 10 about the corresponding support hubs 61*a*, 61*b*. By rotating the pivot plates 46, 48, which are in contact with the support beam 44 through the earns 100 and cam followers 102, the press operator can rotate the support beam 44, thereby adjusting the position of the tail clamp 34.

It should be understood that the tail clamp 34 may be positioned at any point within the groove 42. To accommodate the shortest sized plates 18, the tail clamp 34 is moved to a position within the groove 42 that is furthest away from the lead clamp 24. For the longest sized plates 18, the tail clamp 34 may be positioned as close as possible to the lead clamp 24. An insert 118 (FIG. 3), having an arcuate upper surface 120, which matches that of the cylinder surface 12, may be positioned within the groove 42 on the plate side P of the tail clamp 34 when the tail clamp 34 is positioned to accept longer plates 18. The upper surface 120 of the insert 118 serves to continue the cylinder surface 12 so that the plate 18, rather than being suspended over the groove 42, is supported throughout.

Once the tail clamp 34 is positioned to receive the trailing edge 22 of the printing plate 18, the trailing edge 22 is inserted into the gap in the tail clamp 34 and the cam 35 is rotated from the open to the closed or clamping position, thereby clamping the plate 18 to the tail clamp 34. Each pivot plate 46, 48 is then re-secured to the corresponding end wall 14*a*, 14*b* of the cylinder 10. This is accomplished by tightening the corresponding fasteners 68 associated with the L-shaped clamps 62. It should be understood that the take-up assembly 36 may be used with other types of lead and tail clamps. Although the printing plate 18 is now secured to the cylinder 10 (having been attached to the lead clamp 24 and the tail clamp 34), it is not sufficiently tightened to prevent movement during the imaging or printing cycles.

To tighten the plate 18 about the cylinder 10, the cylinder 10 is first rotated in a reverse direction, opposite to arrow FWD (FIG. 3). Since the actuator shaft 70 ordinarily rotates with the cylinder 10, there is no relative movement between the drive gear 84 and the take-up assembly gear 86. Consequently, there is no rotation of the cams 100. Once the cylinder 10 is brought up to speed, however, the pawl 112 engages the slip clutch 110 and rotation of the actuator shaft 70 is arrested. The pawl 112 may be engaged in response to actuation from the press operator or automatically when the cylinder 10 reaches a specific rate of rotation. The cylinder 10 and the support beam 44, however, continue to rotate, and with the actuator shaft 70 and drive gear 84 now rendered stationary, rotation of the cylinder 10 causes the take-up assembly gear 86 which is being driven with cylinder 10 to rotate around the stationary drive gear 84 as a "planet" gear, thereby turning the rod 88 and the cams 100 relative to the cylinder 10.

Each cam 100 starts rotating from the home position H corresponding to the position of the tail clamp 34 following insertion of the trailing edge 22 of the printing plate 18. From the home position H, the ramp of each cam 100 rises, i.e., the diameter of the cam 100 increases. Since each cam follower 102 is fixed to the corresponding pivot plate 46, 48, the increasing ramp of the rotating cam 100 results in circumferential displacement of the cam away from the cam follower 102, causing the support beam 44 to rotate about axis A—A relative to the cylinder 10. Rotation of the support beam 44 away from the cam follower 102 results in circumferential displacement of the tail clamp 34 away from the plate side P of the tail clamp 34, thereby tightening the plate 18 around the outer surface 12 of the cylinder 10. The tension in the plate 18 is increased until proper plate tension is achieved.

The ramp of the cam 100 may continue to rise after proper plate tension is achieved. This additional increasing ramp causes the trailing edge 22 of the plate 18 to slip out of the tail clamp 34 a slight amount (approximately 2 mm), thereby correcting any longitudinal misalignment between the trailing edge 22 and the tail clamp 34 that might have occurred if the trailing edge 22 was not perfectly flush when clamped to the tail clamp 34. This slight slippage of the plate 18 out of the tail clamp 34 also ensures even tension across the plate 18.

Alternatively, the take-up assembly 36 may be formed from elastic materials such that the entire take-up assembly 36 or specific components thereof, such as the support beam 44, will deform slightly under the load imposed during the tightening process. By allowing the take-up assembly 36 to deform slightly, any misalignment between the trailing edge 22 and the tail clamp 34 can be corrected. It should be further understood that a combination of slippage from the tail clamp 34, as described above, and elastic deformation of the take-up assembly 36 may be employed to correct any misalignment in the plate 18. It should be further understood that a shear spring or other similar device may be employed between the support beam 44 and the tail clamp 34 to allow the tail clamp 34 to shift slightly relative to the support beam 44, thereby correcting any misalignment in the plate 18.

Furthermore, depending on the materials used to fabricate the cylinder 10, some elastic deformation of the cylinder 10 may occur while bringing the plate 18 up to the desired tightness. This may result in an undesirable change in the shape of the cylinder 10. To eliminate any such deformation and restore the cylinder 10 to its original shape, the ramp of the cam 100 may further include a descending section D (FIG. 4B), i.e., a section in which the diameter of the cam 100 decreases, following the increasing ramp section. The descending ramp of the cam 100 results in circumferential displacement of the cam 100 toward the cam follower 102, decreasing the pre-load on the cylinder 10 and restoring the cylinder 10 to its original shape, without moving the plate 18 from the target tension.

Following the active section of the cam 100, which includes the ascending or rising section R and preferably the descending section D just described, the ramp of the cam 100 enters a dwell portion, i.e., the diameter of the cam 100 is constant. When the cam 100 reaches the dwell portion, the plate 18 is wrapped around the cylinder 10 to the target tension. To prevent the cam 100 from rotating any further and thereby moving the plate 18 off of the target tension, the take-up assembly gear 86 contacts the first hard stop 94, stopping any further rotation of the cam 100.

Once the take-up assembly gear 86 contacts the hard stop 94, however, the gear 86 is no longer free to rotate around to the stationary drive gear 84 in the direction of the spinning cylinder 10, causing the torque in the actuator shaft 70 to increase sharply. This sharp increase in actuator shaft torque causes the slip clutch 110 to slip, permitting the actuator shaft 70 to rotate in synchronism with the spinning cylinder 10, even though the stationary pawl 112 remains engaged with the knob 114 on the slip clutch 110. The slip clutch 110 thereby averts any damage being caused to the components of the take-up assembly 36, when rotation of the take-up assembly gear 86 is arrested by the hard stop 94.

The printing plate 18 is now properly tensioned around the cylinder 10 and accordingly, the press operator stops the cylinder 10. When the cylinder 10 has stopped rotating, the press operator releases the pawl 112 and the cylinder 10 is ready for printing or imaging.

The tension established along the plate material 18 is maintained by the position of the cam follower 102 relative to the cam 100. In particular, as shown in FIG. 3, the cam follower 102 is positioned such that it contacts the cam 100 at the plate side P of the tail clamp 34. The support beam 44 is thereby restrained from rotating toward the plate side P of the tail clamp 34 by the earn follower 102, which is fixed relative to the cylinder 10.

At the end of the printing or imaging cycle, the pawl 112 once again engages the slip clutch 110 while the cylinder 10 continues to rotate in the forward direction FWD (FIG. 3). The pawl 112 again can be engaged either by the press operator or automatically. With the pawl 112 engaged, rotation of the actuator shaft 70 is arrested. The cylinder 10 and the support beam 44, however, continue to rotate in a forward direction thereby causing the take-up assembly gear 86 to rotate about the stationary drive gear 84. Rotation of the take-up assembly gear 86, in turn, rotates the rod 88 turning the cams 100.

With the cylinder 10 spinning in the forward direction, however, the earns 100 are rotated opposite to the direction described above in connection with the process of tightening the plate 18. Consequently, the ramp of the rotating cams 100 initially rises a slight amount, increasing the pre-load on the cylinder 10. The ramp then decreases such that the cams 100 along with the support beam 44 are circumferentially displaced toward the cam followers 102 due to the tension in the plate 18 as well as the force of the return springs 104. The circumferential displacement of the support beam 44 and hence the tail clamp 34 continues until the tail clamp 34 returns to the home position H at which point the take-up assembly 86 gear contacts the second hard stop 96, preventing any further rotation of the cams 100. As described above, contact with the hard stop 96 causes the actuator shaft torque to increase sharply, thereby releasing the slip clutch 110 and allowing the actuator shaft 70 to rotate despite continued engagement of the pawl 112.

The press operator then brings the cylinder 10 to rest. With the tail clamp 34 returned to its home position H, the plate 18 is no longer wrapped tightly around the cylinder 10 and, consequently, the press operator can remove the plate 18 quickly and easily. To facilitate removal of the plate 18 from the tail clamp 34, the press operator can manually pivot the tail clamp 34 opposite arrow FWD (FIG. 3), releasing the trailing edge 22 of the plate 18 from the tail clamp 34. To pivot the tail clamp 34 backwards, the press operator simply overcomes the tension of return spring 104.

A stop pin 119 is preferably located on the inner face 46*a* of the pivot plate 46 in proximity to the cam 100 opposite the plate side P of the tail clamp 34. The stop pin 119 prevents the press operator from stretching the return spring 104 beyond its elastic range, when pivoting the tail clamp 34 backwards to release the plate 18. In particular, the cam 100 contacts the stop pin 119 after a pre-selected rotation of the take-up assembly 36, which is sufficient to release the plate 18 from the tail clamp 34 but short of damaging the return spring 104.

After removing the plate 18 from the lead clamp 24, the cylinder 10 is then ready to accept another plate 18 of any length. It should be understood that in order to accommodate another plate 18 of the same length, the tail clamp 34 need not be adjusted relative to the lead clamp 24 by the press operator. Instead, the press operator can simply secure the plate 18 to the lead clamp 24 and the tail clamp 34 and tighten the plate 18 around the outer surface 12 of the cylinder 10 through rotation of the cylinder 10 as described above. If the subsequent plate 18 is of a different length, then the press operator simply adjusts the position of the tail clamp 34 to accommodate the new plate 18 by releasing, rotating and re-securing the pivot plates 46, 48 as described above.

In addition, by engaging the pawl 112 with the cylinder 10 still rotating, the take-up assembly 36 acts as a brake slowing the cylinder 10 down. This braking feature helps the press operator to quickly stop the spinning cylinder 10 at the end of the imaging or printing cycle.

It will therefore be seen that we have developed a reliable and convenient mechanism for adapting a cylinder or drum to receive printing plates of various lengths and which is especially suited to lithographic printing systems. The foregoing description has been directed to specific embodiments of this invention. It will be apparent, however, that other variations and modifications may be made to the described embodiments, with the attainment of some or all of their advantages. Therefore, it is the object of the appended claims to cover all such variations and modifications as come within the true spirit and scope of the invention.

What is claimed is:

1. An adaptive clamping assembly for clamping lithographic plate material having a length around a cylinder having an outer cylindrical surface and a longitudinal axis of rotation, said adaptive clamping assembly comprising:

a first clamp mounted to the outer surface of the cylinder parallel to the cylinder axis;

a single second clamp adjustably disposed along the outer surface of the cylinder parallel to the first clamp and including means for securing an edge of the plate material; and means for selectively positioning the single second clamp circumferentially about the outer surface of the cylinder relative to the first clamp so that the cylinder can accept plate material of at least three differently sized lengths.

2. The adaptive clamping assembly of claim 1 further comprising means for adjusting the second clamp relative to the first clamp allowing the plate material to be wrapped one of tightly and loosely around the cylinder.

3. The adaptive clamping assembly of claim 2 further comprising means for activating the adjusting means selectively and operably in response to the rotation of the cylinder.

4. The adaptive clamping assembly of claim 3 wherein the outer surface of the cylinder includes a series of slots communicating with a cylinder bore and the positioning means and the adjusting means further comprise:

a support beam having an edge, the support beam rotatably mounted about the cylinder axis within the cylinder bore such that the edge of the support beam is proximate to the slots in the cylinder surface and further wherein the second clamp is mounted to the edge of the support beam through the slots in the cylinder surface.

5. The adaptive clamping assembly of claim 4 wherein the cylinder further includes two end walls and the positioning means and adjusting means further comprise:

at least one pivot plate rotatably disposed within the cylinder bore, each pivot plate releasably attached to a corresponding end wall of the cylinder such that rotation of each pivot plate, when released from the corresponding end wall, causes the support beam to rotate thereby selectively positioning the second clamp relative to the first clamp.

6. The adaptive clamping assembly of claim 5 wherein each end wall has an inwardly extending hub for rotatably supporting the corresponding pivot plate and each pivot plate is releasably attached to the corresponding end wall by at least one clamp located on the end wall.

7. The adaptive clamping assembly of claim 5 wherein the adjusting means further comprises:

one actuator shaft extending along the cylinder axis through an end wall of the cylinder such that a first end of the actuator shaft is disposed outside of the cylinder and a second end of the shaft is disposed in the cylinder bore;

a drive gear fixed to the actuator shaft;

a take-up assembly gear rotatably mounted to the support beam, the take-up assembly gear cooperating with the drive gear;

at least one cam fixed to the take-up assembly gear;

a cam follower operably engaging each cam and rotatably mounted to a pivot plate;

a pawl selectably engageable with the first end of the actuator shaft for arresting the rotation of the actuator shaft;

wherein during adjustment, the pawl engages the first end of the actuator shaft causing the take-up assembly gear through rotation of the cylinder to rotate about the drive gear, thereby turning each cam against the cam follower operably engaged thereto so as to cause circumferential displacement of the second clamp relative to the first clamp.

8. The adaptive clamping assembly of claim 7 wherein the take-up assembly gear further comprises at least one hard stop preventing the cam from rotating more than one complete revolution in either direction.

9. The adaptive clamping assembly of claim 8 wherein each cam has an increasing ramp section.

10. The adaptive clamping assembly of claim 9 wherein each cam has a decreasing ramp section following the increasing ramp section.

11. The adaptive clamping assembly of claim 10 wherein each cam has a dwell section following the decreasing ramp section.

12. The adaptive clamping assembly of claim 7 further comprising a slip clutch disposed about the second end of the actuator shaft that slips when a pre-selected shaft torque is exceeded.

13. The adaptive clamping assembly of claim 4 wherein the support beam further includes a series of corresponding projections extending outwardly from the edge of the support beam through the slots in the surface of the cylinder and the second clamp is mounted to the projections.

14. The adaptive clamping assembly of claim 4 wherein the support beam is elastically deformable and further comprising means for imposing an even tension along the longitudinal extent of the plate wherein the imposing means includes the elastically deformable support beam.

15. The adaptive clamping assembly of claim 1 wherein the positioning means is disposed within the cylinder.

16. The adaptive clamping assembly of claim 1 further comprising means for imposing an even tension along the longitudinal extent of the plate.

17. The adaptive clamping assembly of claim 16 wherein the imposing means includes means for releasing a portion of the plate material out of the tail clamp after the plate has been wrapped tightly around the outer surface of the cylinder.

18. An adaptive clamping assembly for clamping lithographic plate material having a length around a cylinder having an outer cylindrical surface and a longitudinal axis of rotation, said adaptive clamping assembly comprising:

a first clamp mounted to the outer surface of the cylinder parallel to the cylinder axis;

a single second clamp adjustably disposed along the outer surface of the cylinder parallel to the first clamp and including means for securing an edge of the plate material; and means for clamping a plate material of any length within a predetermined length range including means for selectively positioning the single second clamp about the outer surface of the cylinder relative to the first clamp so that the second clamp may receive and secure the edge of the plate material.

19. The adaptive clamping assembly of claim 18 further comprising means for adjusting the second clamp circumferentially allowing the plate material to be wrapped one of tightly and loosely around the cylinder.

20. The adaptive clamping assembly of claim 19 further comprising means for activating the adjusting means selectively and operably in response to the rotation of the cylinder.

* * * * *